United States Patent [19]

Chapman et al.

[11] 4,144,538

[45] Mar. 13, 1979

[54] METHOD AND APPARATUS FOR COATING FUSIBLE INTERLININGS

[75] Inventors: Frank Chapman, Pinner; David Holt, Cambridge, both of England

[73] Assignee: Staflex International Limited, London, England

[21] Appl. No.: 778,064

[22] Filed: Mar. 16, 1977

[30] Foreign Application Priority Data

Mar. 19, 1976 [GB] United Kingdom ..... 11294/76

[51] Int. Cl.[2] ..... G03G 17/00; B05B 5/02

[52] U.S. Cl. ..... 346/153; 118/638

[58] Field of Search ..... 346/153; 118/638, 653

[56] References Cited

U.S. PATENT DOCUMENTS

| | | | |
|---|---|---|---|
| 3,257,222 | 6/1966 | Carlson | 346/153 |
| 3,289,209 | 11/1966 | Schwertz | 346/153 |
| 3,701,996 | 10/1972 | Perley | 346/153 |
| 3,946,402 | 3/1976 | Lunde | 346/153 |

*Primary Examiner*—Jay P. Lucas

*Attorney, Agent, or Firm*—Eliot S. Gerber

[57] ABSTRACT

A fabric substrate is passed through an electric field in order to set up a charge on the surface of the substrate and to thereby cause a particulate adhesive material stored in a container over which the substrate passes to be attracted to the surface of the substrate by electrostatic attraction. The coated substrate is subsequently heated to melt the adhesive material so that it agglomerates and adheres permanently to the substrate, thus forming a fusible interlining.

13 Claims, 8 Drawing Figures

METHOD AND APPARATUS FOR COATING FUSIBLE INTERLININGS

This invention relates to a method and apparatus for coating fusible interlinings.

Fusible interlinings are well known in the garment industry. They comprise a fabric substrate which may be woven, nonwoven or knitted, on which is deposited a discontinuous coating of an adhesive material in the form of a thermoplastic resin, either randomly distributed or uniformly distributed, in the latter case by a printing method. The fusible interlining is secured in position in a garment by the application of heat and pressure which causes the interlining to become bonded to the face fabric of the garment.

In the printing method, the thermoplastic resin is applied in the form of plastisol, or as an aqueous dispersion of the resin, or in the form of a dry powder, in order to provide a pattern of regularly spaced small dots on one surface of the substrate.

Where a powdered resin is used, it may be applied to the fabric substrate by being passed through a perforated cylindrical screen having the desired pattern on to the substrate which is subsequently heated in order to consolidate the resin particles and to fix the resultant dot on to the substrate. In an alternative method the powder is first deposited onto a roll engraved with shaped cavities which retain the powdered resin in the cavities and then transfer the consolidated resin dots on to a pre-heated substrate. The shape of the dots deposited on the substrate depends upon the shape of the cavities. For example, the cavities and hence the dots, may be hemispherical in shape.

The important factors in the production of fusible interlinings by the printing method are as follows:

(a) speed of coating (b) positional accuracy of the resin deposit (c) reliability, i.e. absence of coating faults (d) versatility, i.e. the ability to change rapidly the dot size, dot pattern and coating weight of the resin on the surface.

The known coating methods above mentioned fail to meet these requirements in one or other respect; for example, plastisols, on account of their rheology and high viscosity, cannot be printed at high speed. Reliability is reduced with all the above methods when running at high speed. In the perforated screen method missing dots can arise due to screen blockages, and in the engraved roll method there is the danger that the apparatus may fail to evacuate all the cavities in the roll. All the known processes necessitate a shut down when changing the pattern or the coating weight.

The present invention seeks to obviate or reduce the above mentioned failings in the known methods.

In accordance with a first aspect of the invention, there is provided a method of coating fusible interlinings, said method comprising passing a fabric substrate through an electric field set up between an open container of adhesive maerial in particulate form and a conductor so that, as the substrate is passed through the field, the adhesive material is attracted to the substrate by electrostatic attraction, thereby building up a coating of adhesive material on one surface of the substrate, and heating the substrate and coating to consolidate the adhesive on the surface of the substrate.

In accordance with a second aspect of the invention, there is provided apparatus for coating fusible interlinings, said apparatus comprising a container for holding an adhesive material in particulate form, means for applying an electric field between the adhesive material, when present, and a conductor, means for moving a fabric substrate to be coated through the electric field so that the particulate adhesive material can be attracted to the substrate by electrostatic attraction and means for heating the substrate and coating to consolidate the adhesive on the surface of the substrate.

The process is preferably continuous, a system of drums or rollers being employed to feed the substrate, in the form of a web, first to the drying oven, thence over the container of adhesive material, and finally to the consolidating heating means. Conveniently one of such rollers also forms said conductor, between which and the adhesive material said electric field is set up.

In order to ensure good results, the substrate should have a moisture content less than 5%, preferably 2–3%, although the exact figure depends on the particular material used for the substrate. The low moisture content is necessary in order to ensure that the fabric substrate is a good dielectric in order to minimise charge leakage. If the substrate is not a good dielectric, poor dot definition and low coating weight results. To provide good results, it has been found necessary to bring the surface resistivity of the substrate to a value of not less than $10^{12}$ ohms per square.

Many types of fabric substrate of different fibre composition can be used. For example, woven, nonwoven, knitted and weft inserted knitted fabrics are all suitable. Certain of the wholly synthetic fabrics, for example nylon or polyester, already possess low moisture contents, suitable for use directly with the method and apparatus of this invention. However, with non-synthetic fibres, it may be necessary to predry the fabric substrate in a drying oven prior to passing it through the electric field in order to bring its moisture content down to a suitable level, as quoted above.

During passage of the substrate through the electric field, particles of adhesive are caused to move towards the substrate by means of charges induced in the surface of the substrate by the particles, and to adhere to the substrate. This process is enhanced by the presence of the conductor behind the substrate since the charged particles of adhesive can thereby induce mirror-charges of opposite polarity in the conductor which increase attraction of the particles towards the conductor, and hence the substrate. Having reached the substrate, the particles are retained by the induced charges until such time as they are permanently consolidated theron by the consolidating heating means.

In an embodiment of the invention means are provided for charging specific areas of the substrate prior to it being passed through said electric field. It has been found that this enables a discontinuous coating of adhesive material to be deposited since the adhesive particles, during their passage through the electric field from the container tend to migrate to those areas of the substrate where the greatest electric field exists. More particularly, the existence of specific areas of charge on the substrate in turn implies the existence of an electric field between differently charged areas of the substrate. The adhesive particles tend to be attracted to those areas of the substrate where this latter mentioned electric field exists — i.e. around the edge of each discrete charged area. In practice, this is not the disadvantage which may at first appear, since the relative size of the discrete areas of charge, and the size of the adhesive particles, as well as the weight of particles which are attracted to each area ensures that the whole area is given a coating of adhesive particles.

In a preferred embodiment of the invention the means for charging specific areas of the substrate comprises an array of styli which is used to write a charge pattern onto the surface of the fabric substrate, which substrate is then passed through the electric field so that the particles are attracted only to certain discrete areas, as described above. It will be clear that, by selective energisation of the styli, particular charge patterns, and hence coating patterns, can be built up.

Preferably, the array of styli takes the form of a row of styli spaced at intervals across the width of the substrate, the substrate being caused to move continuously under, and in contact with the styli. For extra versatility, more than one row of styli may be fitted in the direction of movement of the substrate. Each such extra row of styli is laterally staggered with respect to the others, and this allows a wider variety of patterns to be accommodated. In addition, a voltage is applied between the or each row of styli and a further conductor so as to develop an electric field, hereinafter referred to as the "further electric field", between the two. In order to write the charge pattern onto the substrate, the substrate is moved through this further electric field prior to being moved through the first-mentioned electric field. However, in order to achieve accurately defined areas of charge, it has been found necessary to actually move the substrate in contact with the styli and the further conductor, so that the substrate is sandwiched between the two, the whole in effect forming a capacitor with the substrate as dielectric.

As before, one of the rollers used for transporting the substrate can conveniently double as the further conductor and indeed, in a preferred embodiment of the invention, a single roller acts as both the first and second mentioned conductors.

The voltage applied between the styli and said further conductor may be continuous, which results in the substrate being coated with parallel lines of adhesive material, or pulsed, which results in the substrate being coated with a series of short lines or dots of adhesive material. Clearly the pattern and arrangement of adhesive material in the pattern may be readily changed by controlling the magnitude and pulse width of the voltage applied to the styli in conjunction with the speed of movement of the substrate past the styli. In addition, the voltage applied to the styli may be pulsed at different frequencies to produce variations in the pattern of the deposited adhesive material. A suitable combination of the geometry of the styli and the pulsing frequency of the applied voltage permits wide variations in the pattern of the adhesive coating on the substrate.

Usually the same voltage waveform is applied to all of the styli in each row, although for reasons which are explained hereinafter, the styli are not necessarily electrically connected together for this purpose. If all the styli receive the same voltage waveform, it will be clear that the deposited adhesive material will extend over a width of the substrate corresponding to the length of the or each row of styli, which itself normally corresponds to the overall width of the substrate. On the other hand it will be seen that selective energisation of the styli will enable some parts of the substate to be deposited with a different pattern of material, or even no material at all.

Many types of particulate adhesive material can be used. For example, polyethylenes of varying density, polyamides, ethylene vinyl acetate copolymers and epoxy resins and mixtures thereof are all suitable. Preferably the adhesive material takes the form of a thermoplastic resin. In addition, the particle size of the adhesive material can be varied, and particle sizes from 0 to 500 microns are suitable. The preferred size range is 60 to 200 microns.

The adhesive material may be in dry powder form or may be in liquid form, although liquid form in this case means a suspension of particles in a liquid. In the latter case, if the particles are to be electrostatically charged the liquid must be of low conductivity and the substrate is passed through the liquid so that the particles are electrostatically attracted to the substrate during its passage through the liquid.

The weight of adhesive particles which are attracted to any particular area of the substrate is dependent upon a number of factors, including the speed of the web substrate as it passes the adhesive material, the weight of individual adhesive particles, the distance between the substrate and the adhesive particles and the magnitude of the charge potential between the substrate and the particles in that area. The amount of charge deposited is controlled by the magnitude of the applied voltage and by the length of time for which the voltage is applied. Thus, for a given arrangement of adhesive container and substrate, both the coating weight and, in the case of a discontinuous coating, the pattern of the coating can be changed in a matter of seconds by altering the magnitude and pattern of the charge applied to the substrate and the magnitude of the charge applied to the adhesive material.

In some circumstances, it may be desirable to supply the substrate with a uniform background charge of opposite polarity to that of the styli prior to being passed across the styli. The voltage applied to the styli thus discharges this uniform charge, in those areas in contact with energised styl, and replaces it with a net charge of opposite polarity. The adhesive material is also given a charge of the same polarity as the background charge so that it will be attracted towards the areas charged by the styli. This improves the definition of the edge of the lines or dots of adhesive material by increasing the field gradient between the background and the dot or line and also helps to eliminate the deposition of adhesive particles on those areas where a deposit is not required.

The uniform background charge can be produced by means of a corona discharge from a corotron in the form of a wire extending across the substrate. The wire is positioned so that the substrate passes close to it prior to passing across the styli.

In order that the invention may be better understood, several embodiments thereof will now be described by way of example only and with reference to the accompanying drawings in which.

Figure 1:
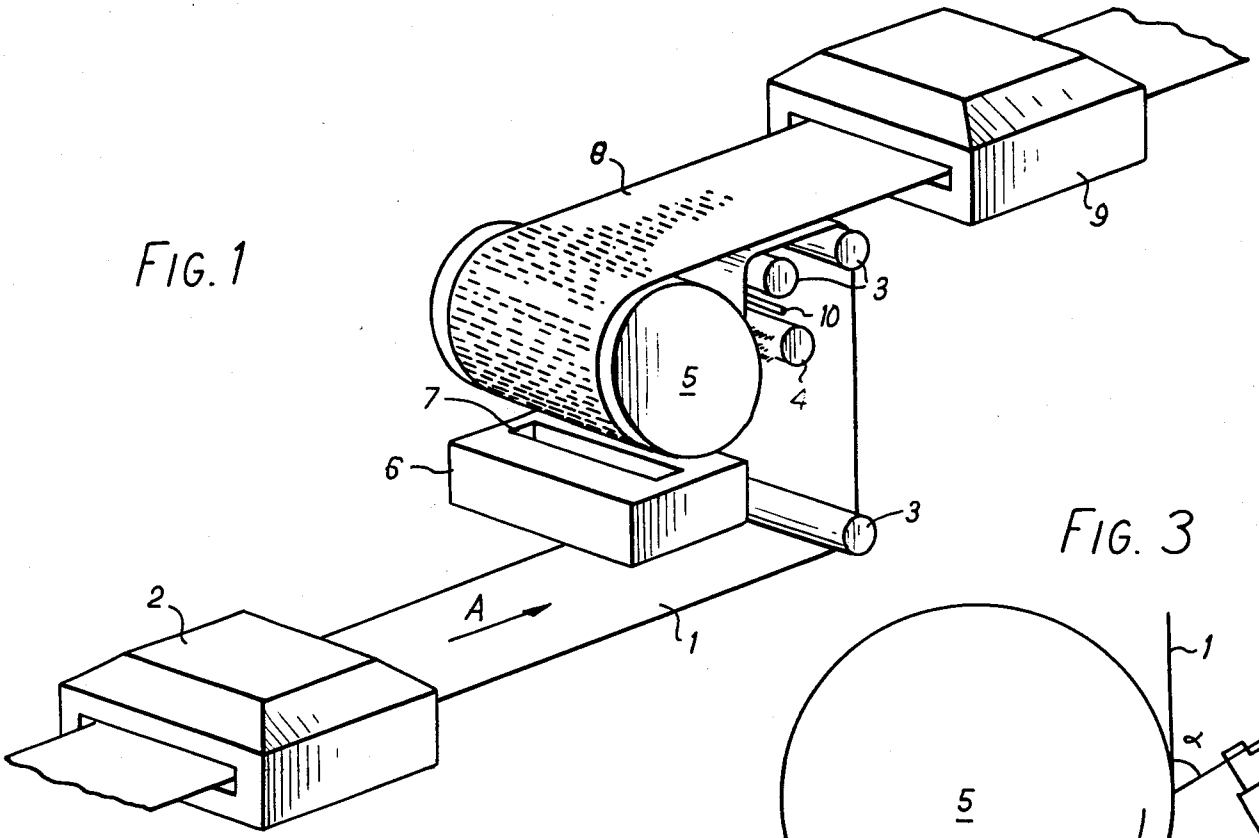
FIG. 1 is a schematic diagram of an apparatus for coating fusible interlinings in accordance with the invention.

Referring to FIG. 1, a fabric substrate in the form of a web 1 which is to be coated is passed in the direction of the arrow A through a hot-air predryer 2 so as to achieve the necessary surface resistivity. The web is then taken around guide rollers 3 and around a drum 5. The drum 5 is made of steel, and is preferably hardened, at least on its peripheral surface, to minimise wear.

The web on its passage around the drum passes under two stylus banks 4 where the desired charge pattern is applied. The two banks of styli extend across the whole width of the web, and are laterally staggered with respect to one another by one half of a stylus pitch. This arrangement of stylus banks enables greater versatility in the variety of patterns deposited on the web.

The electrostatically patterned web then passes over a container in the form of a fluidised bed 6 of adhesive powder particles. An electric field is set up between the adhesive particles in the fluidised bed 6 and the drum 5. The existence of this electric field causes the powder particles to migrate from the fluidised powder surface 7 of the fluidised bed onto the already charged web to produce a coated web 8. The distance between the powder surface 7 and the substrate is not critical but, wheatever distance is used, it must be maintained reasonably constant. After passing over the fluidised bed 6, the coated web then passes through a consolidation oven 9 where the powder particles melt, agglomerate and adhere permanently to the web.

If desired a corotron 10 may be included in the position shown. The corotron comprises a line of wire inside a grounded metal electrode, the purpose of which is to define a high electrostatic field around the wire sufficient to ionise the air surrounding the wire. The grounded metal electrode has an opening along its length through which some of the ions so formed can pass. The corotron is positioned with the opening laterally across the web and facing the surface of the web. The ions are produced by applying a large voltage, typically 5 - 10 KV, between the wire and the electrode.

Finally the heating process is followed, when necessary, by compacting the adhesive deposit on the substrate and cooling the coated substrate before batching it into rolls of fusible interlining.

The speed of movement of the web can be varied, but calculations show that speeds up to 500 meters per minute are theoretically possible, given appropriate heat consolidation equipment. Speeds of 60 to 100 meters per minute have so far been achieved in practice. Furthermore, it has been found desirable to slightly tension the web both in the longitudinal and lateral directions in order to avoid the possibility of kinking as it passes through the apparatus.

Figure 2:
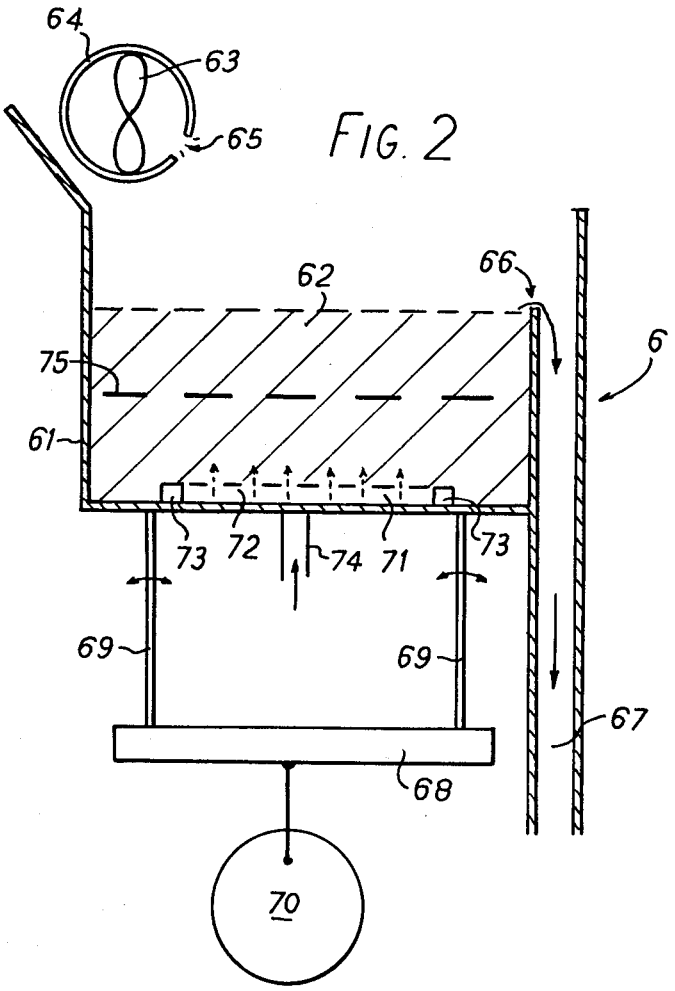
FIG. 2 is an enlarged diagrammatical sectional elevation of the fluidised bed in the apparatus of FIG. 1.

Referring now to FIG. 2, there is shown the details of the fluidised bed 6. The bed comprises an elongate trough 61 made of fiber glass in which the adhesive material, shown under reference 62, is contained. Fresh adhesive material is fed continuously into the trough 61 by means of an Archimedian screw feed 63 acting within a tube 64. A series of holes 65 distributed along the tube allow the adhesive material to fall into the trough. The level of adhesive material in the trough in maintained by means of a weir 66, excess material exiting through an elongate passageway 67 to be recycled.

The trough is mounted on a rigid beam 68 by means of a plurality of vertical spring strip members 69. During operation, the beam 68 is vibrated by means of a number of eccentrics 70. The strip members 69 act to remove the horizontal component of this vibration so that the trough 61 is caused to vibrate only in a vertical direction. In addition, a plenum chamber 71 is formed in the bottom of the trough by means of a porous sheet 72 supported on a pair of elongate support members 73. During operation, air is pumped into the pleunum chamber 71 from a pipe 74 and distributes itself within the adhesive particles. The effect of this is to alter the properties of the adhesive particles so that, collectively, they act like a liquid. Also, the particles lose the tendency to adhere to one another, and so can be picked up evenly during electrostatic attraction.

A metal grid 75 is situated above the porous sheet 72 and is connected to the H.T. supply, typically at 20 KV, in order to set up the electric field beween the adhesive material 62 and the drum 5.

Figure 3:
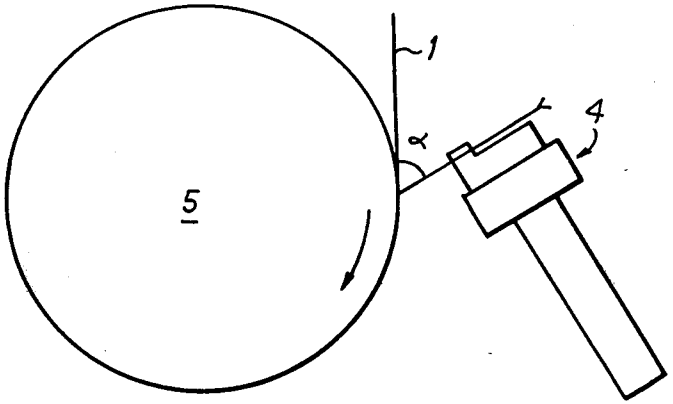
FIG. 3 is an enlarged side view of part of the stylus assembly used in the apparatus of FIG. 1.

Referring now to FIG. 3, there is shown an enlarged view detailing the arrangement of the stylus banks 4. For clarity only one bank is shown. For convenience in manufacture, each stylus bank 4 is made up of a plurality of sections, for example five sections. Each section comprises an elongate mounting block 41 of insulating material in which a plurality of styli 42 are embedded. Each stylus 42 is made of hardened spring steel and extends outwards toward the drum 5, making an angle $\alpha$ with the tangent to the drum at the point of contact. The angle $\alpha$ can be between 20° and 40°, but is preferably 30°. It has been found desirable to maintain a constant pressure between the tips of the styli and the drum 5, since this ensures a constant contact resistance. Pressures between 10 and 50 grams have been found satisfactory, with best results at about 20 grams pressure per stylus.

The mounting block 41 is itself mounted on a metal backing block 43 which carries a framework 44. The framework 44 carries a circuit board on which is mounted a plurality of isolating resistors, (not shown). As already mentioned, it will generally be desired to supply the same voltage waveform to each of the styli and, of course, for this purpose all of the styli can be electrically connected together. However, such an arrangement suffers from the disadvantage that, should one of the styli become earthed for any reason (for example due to a small fault in the substrate), the whole bank will become momentarily earthed, and the end result will be a narrow transverse strip extending the full width of the substrate where the desired coating pattern is not applied. The above mentioned isolating resistors are intended to avoid the above disadvantage. Each stylus is connected to an individual high value resistor, typically 20 M, and the ends of all such resistors electrically remote from the respective styli are commoned. The electrical signal to be applied to the stylus is then applied to this common connection, rather than directly to the styli.

Figure 4:
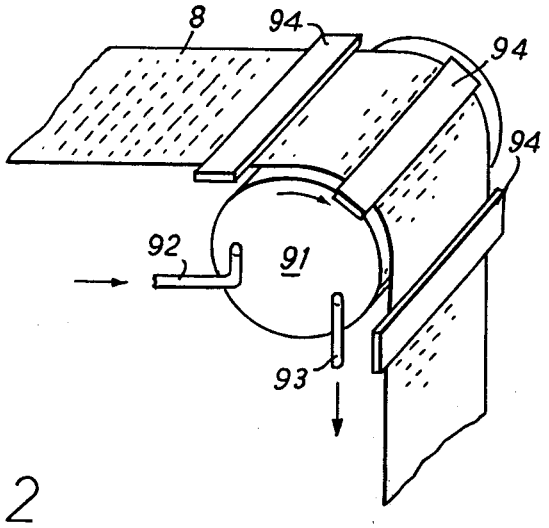
FIG. 4 is a diagrammatical perspective view of one form of consolidating heater for use with the apparatus of FIG. 1.

Referring now to FIG. 4, there is shown one form which the consolidating heater 9 may take. The coated web 8 is passed, coated side out, around a rotating drum 91, typically of 1 meter diameter. The drum 91 is heated to a temperature in the region of 200° C by a system of recirculated hot oil. The oil is heated by means (not shown), enters the drum through an inlet pipe 92 and exits through an outlet pipe 93. In addition infra-red heaters 94 are situated around the periphery of the drum, and spaced from the web, to assist in the consolidation process. The whole assembly is enclosed by a cover (not shown).

To consolidate the adhesive deposit, an infra-red oven or other conventional forms of heating may be used if desired.

Figure 5:
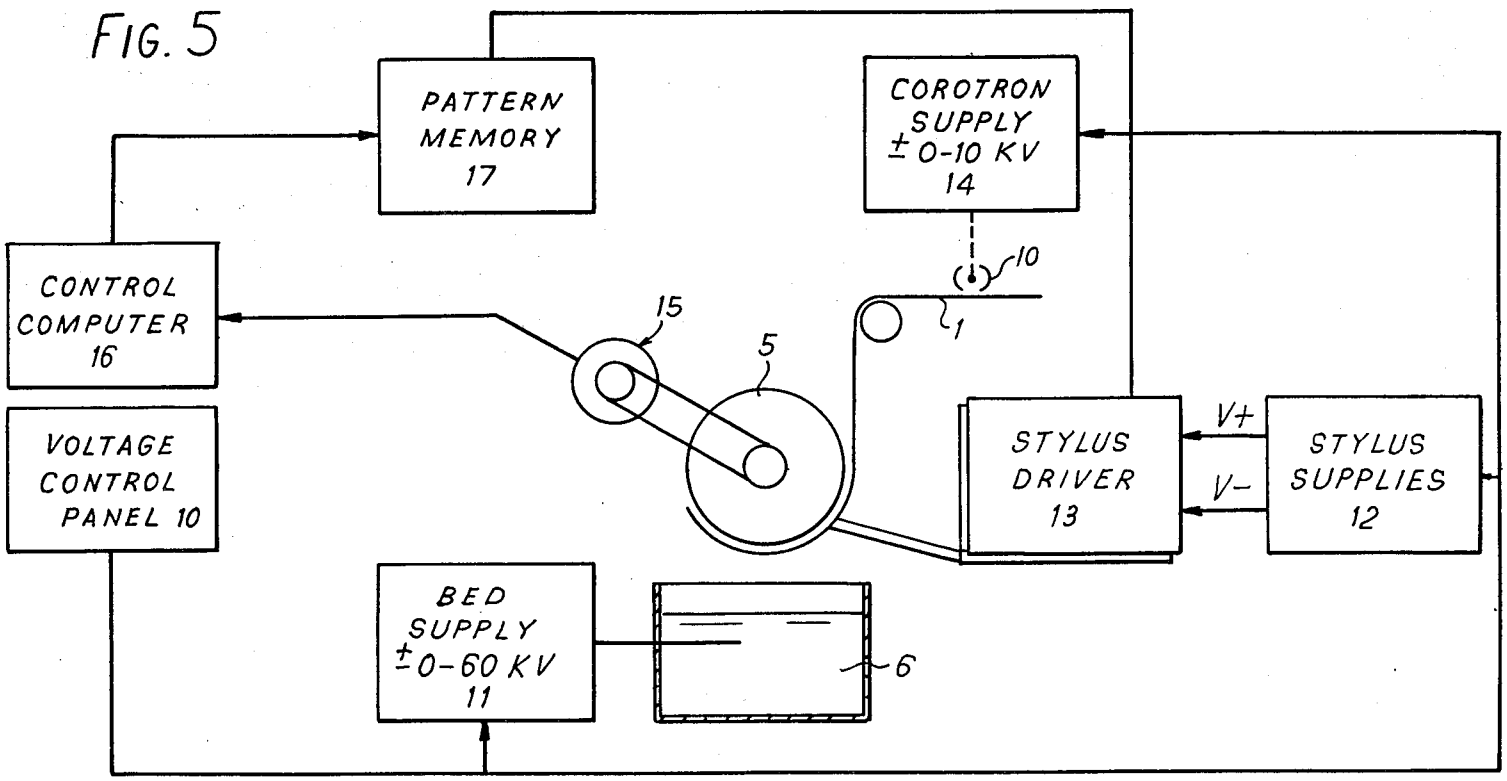
FIG. 5 is a schematic diagram of the electronic system which controls the apparatus of FIG. 1.

Referring now to FIG. 5, there is shown an electronic system suitable for controlling the apparatus of FIG. 1. The system comprises a central control panel 10 which controls the magnitudes and polarities of the electrostatic charge supplies, these supplies being essentially constant when the apparatus is operating at constant speed.

The control panel 10 is used to control a voltage supply 11 for the fluidised bed 6, and hence the charge on the adhesive powder in the fluidised bed 6. The panel 10 also controls a stylus voltage supply 12 which in turn controls a pair of stylus driver circuits 13, each connected to a respective stylus bank thereby controlling the charge pattern of the web. Finally, the panel 10 controls a voltage supply 14 for the corotron (if fitted).

An optical encoder 15 senses the speed of the moving web, and controls the switching speed of a small control computer 16. The variations in switching speed causes the pattern on the web to be maintained constant irrespective of variations in the web speed. The control computer 16 itself controls a pattern memory 17 in which information concerning the coating pattern (or, more usefully, information concerning a variety of coating patterns) is stored. In effect the pattern memory provides information such as pulse width to the stylus driver circuits 13 in order that the required coating pattern is deposited. It will be seen that it is readily possible, simply by altering the programme, to select a different coating pattern.

Figure 6:
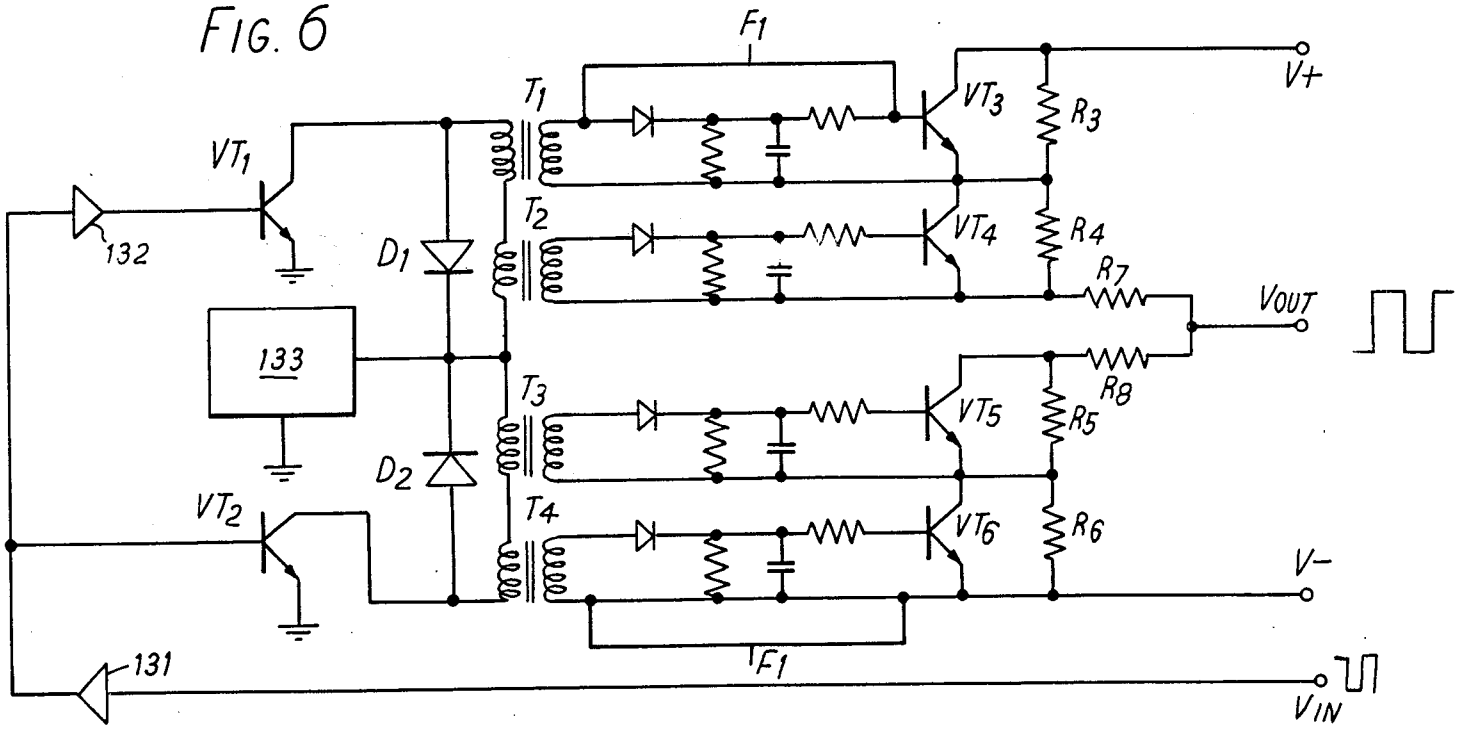
FIG. 6 is a detailed circuit diagram of the stylus driver circuit of FIG. 5.

The detailed circuit of each stylus driver circuit 13 is shown in FIG. 6 to which reference will now be made. The function of the circuit is to provide, at an output terminal $V_{out}$ a high voltage pulse output swinging alternately between two supply rails V+ and V− for application to the styli. The D.C. voltage on the supply rails V+ and V− is provided by respective high voltage power units (not shown) and is independently controllable.

The pulse output is controlled by a pulse signal received at input terminal $V_{in}$ from the pattern memory 17. The input pulse signal is passed through a buffer amplifier 131, whereafter the signal is split into two separate paths for independently controlling a pair of switching transistors VT1 and VT2. The pulse input signal applied to transistor VT1 is applied via an inverter 132 so that, as the input pulses are received, the two transistors VT1 and VT2 conduct alternately. Each transistor VT1 or VT2 is connected in series with the series connected primary windings of a respective pair of transformers T1, T2 or T3, T4. One end of each of the primary windings of transformers T2 and T3 are connected together, as shown, and are connected to the output of a 150 kHz high power oscillator 133. Thus the output of the oscillator 133 is passed alternately to the primary windings of transformers T1, T2 then T3, T4.

The transformers T1 to T4 are insulated to withstand the high voltages of the supply rails V+ and V−, and so protect and isolate the input stages. The secondary windings of transformers T1 to T4 are each connected to a respective peak detector, shown collectively under the reference F1. The operation of such detectors is well known, and will not be described further. Suffice to say that a voltage approximately equal to the peak value of the voltage induced in the secondary windings of the transformers T1 to T4 is applied between the base and emitter of a respective one of four output transistors VT3 to VT6.

The turns ratio of each of the transformers T1 to T4 is such that, when energised, the voltage appearing at the secondary of each transformer is sufficient to trigger the respective output transistor into conduction. Thus, it will be seen that, when transistor VT1 is switched ON, the output signal from oscillator 133 is applied to the primary windings of transformers T1 and T2, to thereby switch output transistors VT3 and VT4 ON, and apply the positive potential V+ to the output terminal $V_{out}$. Similarly, when transistor VT2 is switched ON, the output signal from oscillator 133 is applied to the primary windings of transformers T3 and T4 to thereby switch output transistors VT3 and VT4 ON, and apply the negative potential V− to the output terminal $v_{out}$.

Resistors R3, R4, R5 and R6 are biassing resistors to balance the voltage drop across each output transistor when in the OFF state. Resistors R7 and R8 act to limit the current which can flow between the supply rails during the switch transition period when, owing to the finite turn-off time of the output transistors, all the output transistors are conducting at the same time.

It will be clear that the positive and negative amplitude of the output pulse signal is readily changed by adjustment of the voltage on the supply rails. Thus in one typical arrangement the adhesive material in the fluidised bed 6 is charged to a positive potential (for example 20KV) relative to the drum 5, while the pulse signal applied to the styli varies between the positive supply rail at, say 500 volts and the negative supply rail at, say 1kV. When the substrate is passed over the fluidised bed 6 adhesive particles are attracted to those parts of the substrate which are charged by the −1KV potential, and tend to avoid those parts charged by the +500V potential. As a result, a regular pattern of dots or lines of adhesive material is formed on the substrate.

There has been described a method and apparatus for depositing particulate adhesive onto a substrate in a prescribed pattern which is reliable, and is capable of high coating speeds with positional accuracy and controlled flexibility. In addition, a wide variety of patterns may be formed on the substrate by controlling the pulse repetition frequency and pulse width of the signal applied to the styli. Different coating weights may be accommodated by altering the electrostatic potentials, either of the styli, or of the fluidised bed 6, or both. In addition polarities of the charges in all the different parts of the apparatus can, of course, be reversed.

EXAMPLE

A 100% cotton substrate in the form of a web was predried to a moisture content of approximately 2% and was then passed under a single stylus bank in order to write a dot charge pattern onto its surface. The styli were connected to receive a high voltage pulse signal consisting of alternate pulses of +500V and −1KV. The web of substrate was then passed over a fluidised bed containing terpolymer polyamide powder having a particle size in the range 60 to 200 microns. The powder was charged to a positive potential of 20KV, so that the web became coated with the terpolymer polyamide powder to a coating weight of approximately 15 grams/sq. meter. The web was then heated to consolidate the powder onto the substrate, and finally cooled.

Figure 7:
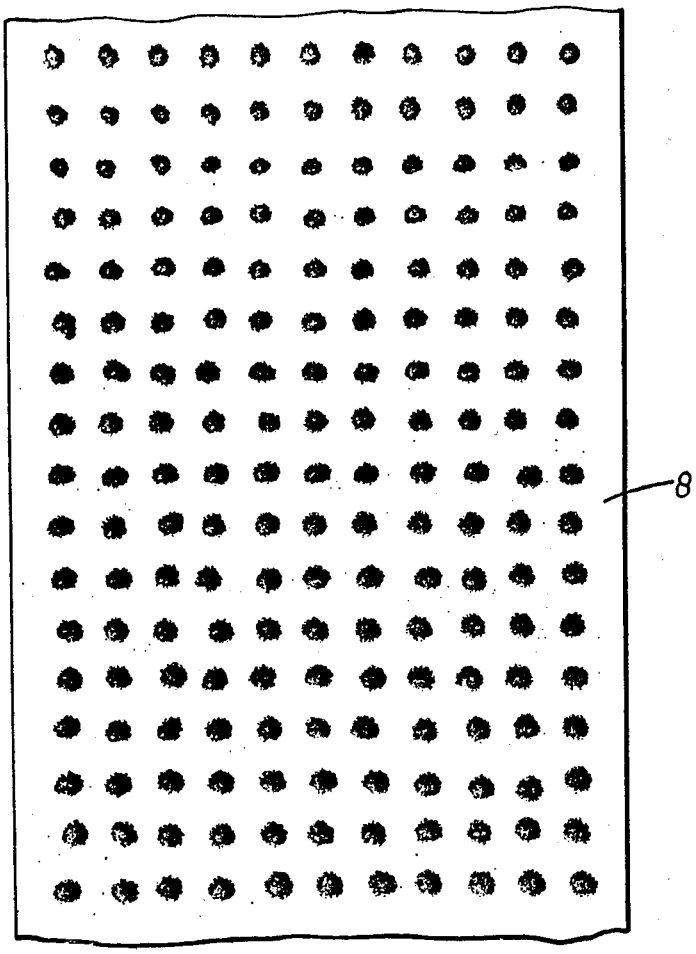
FIGS. 7 and 8 show two examples of patterns of adhesive material applied to a substrate.
Figure 8:
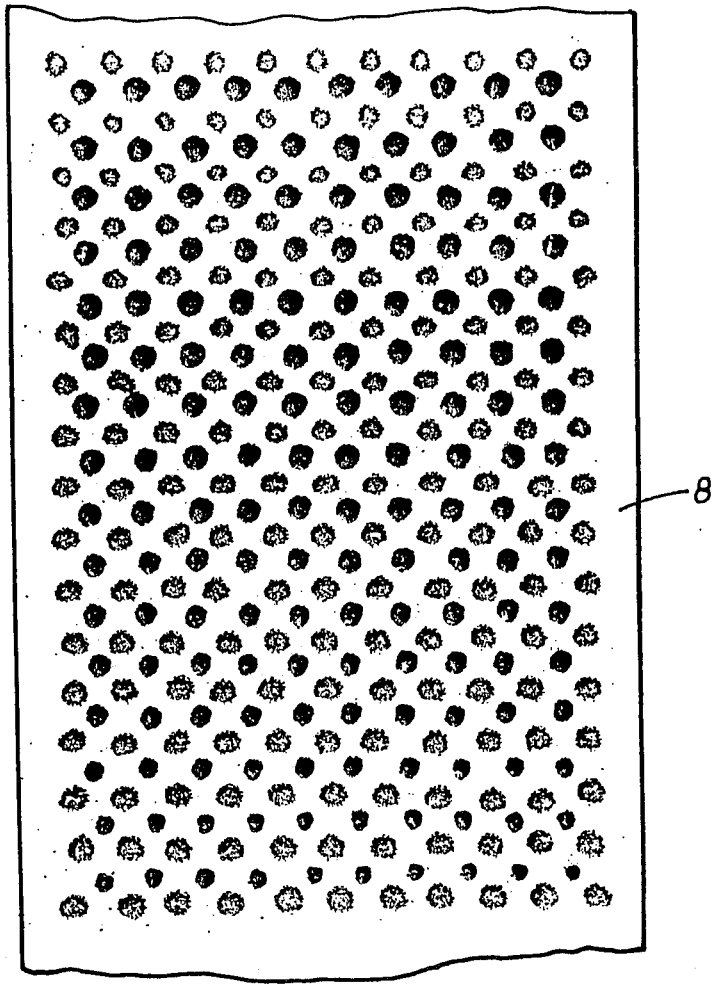

The resultant dot pattern is shown in FIG. 7, where it will be seen that the pattern comprises a regular array of equally spaced dots of adhesive material, arranged in squares. The dots of adhesive are approximately 0.4 mm in diameter and their centres are approximately 1.5 mm apart. It will be apparent that additional rows of dots, each dot being positioned in the centre of each present square of dots, could be accommodated by the use of two bands of styli laterally staggered with respect to one another by one half of a stylus pitch and by applying to the second bank of styli the same pulse signal as that applied to the first, but phase shifted by a suitable amount. Such an arrangement is shown in FIG. 8.

The finished fusible interlining was then bonded to a polyester worsted fabric using conventional methods and the resultant laminated product proved satisfactory in performance.

We claim:

1. Apparatus for coating fusible interlinings, said apparatus comprising means for moving an electrically insulative fabric substrate to be coated through the apparatus, a drying oven for predrying the substrate, a metal drum over which the substrate moves, a bank of styli extending parallel to the axis of the drum said bank of styli comprising a plurality of parallel co-planar wires arranged in the manner of the teeth of a comb, the free ends of the styli being biased toward the peripheral surface of the drum such that the substrate can move between the free ends of the styli and the drum surface, means for applying a high voltage between the drum and the styli in order to set up a first electric field through which said substrate passes, said first electric field being operable to apply an electrostatic charge pattern to the predried substrate, a container for holding an adhesive material in particulate form, means for applying a second electric field between the adhesive material and the drum, the styli and the adhesive container being angularly spaced about the drum such that the fabric substrate moves first in contact with said styli and thence through the second electric field set up between the adhesive container and the drum, said second electric field being operable to attract the particulate adhesive material to the substrate by electrostatic attraction, which adhesive, by virtue of the charge pattern previously applied by the styli, arranges itself in the form of a discontinuous coating of adhesive material on the substrate, and means for heating the substrate and discontinuous coating to consolidate the adhesive on the surface of the substrate.

2. Apparatus as claimed in claim 1 further including means for continuously feeding fresh adhesive material into the container, and means for removing surplus adhesive material from the container in the event that the level of material within the container exceeds a predetermined amount.

3. Apparatus as claimed in claim 2 wherein the means for removing surplus adhesive material comprises a weir over which surplus material may fall, and means for vibrating the container to encourage material to flow over the weir.

4. Apparatus as claimed in claim 2 including means for recycling the surplus adhesive material back to said feeding means.

5. Apparatus as claimed in claim 1 wherein said container is equipped with a metal wire grid, submerged in use within the adhesive material, and wherein means are provided for applying a high voltage between said grid and the conductor in order to set up said electric field.

6. Apparatus as claimed in claim 1 wherein all of the styli in the bank are connected to receive the same voltage.

7. Apparatus as claimed in claim 1 wherein the high voltage comprises a high voltage pulse signal.

8. Apparatus as claimed in claim 1 wherein said consolidating heating means further comprises additional heating means arranged around and spaced from said heated roller.

9. Apparatus as claimed in claim 1 further including means for applying a uniform background charge to the substrate prior to being charged by said bank of styli.

10. Apparatus according to claim 1 wherein the drying oven is operable to predry the substrate to a moisture content of less than 5%.

11. Apparatus as claimed in claim 1 wherein said container takes the form of a fluidized bed.

12. Apparatus as claimed in claim 1 wherein there are provided two of said banks of styli, said two banks being spaced apart in the direction of movement of the substrate, and laterally staggered with respect to each other by one half of the stylus pitch.

13. Apparatus as claimed in claim 1 wherein said consolidating heating means comprises a heated roller around which the substrate is passed.

* * * * *

UNITED STATES PATENT OFFICE

CERTIFICATE OF CORRECTION

Patent No. 4,144,538 Dated March 13, 1979

Inventor(s) Frank Chapman and David Holt

It is certified that error appears in the above-identified patent and that said Letters Patent are hereby corrected as shown below:

Column 4, line 40, "styl" changed to --styli--;

Column 6, line 12, "pleunum" changed to --plenum--

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*